US006558215B1

(12) United States Patent
Boatman

(10) Patent No.: US 6,558,215 B1
(45) Date of Patent: May 6, 2003

(54) FLOWLINE TERMINATION BUOY WITH COUNTERWEIGHT FOR A SINGLE POINT MOORING AND FLUID TRANSFER SYSTEM

(75) Inventor: L. Terry Boatman, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/060,514

(22) Filed: Jan. 30, 2002

(51) Int. Cl.[7] ..... B63B 21/00
(52) U.S. Cl. ..... 441/5; 114/230.13
(58) Field of Search ..... 114/293, 230.1, 114/230.2, 230.13; 441/1, 3, 4, 5; 405/210; 141/382, 387, 388

(56) References Cited

U.S. PATENT DOCUMENTS

| | | | | |
|---|---|---|---|---|
| 3,466,680 A | | 9/1969 | Schirtzinger | |
| 3,834,432 A | * | 9/1974 | Lilly et al. | 441/4 |
| 3,979,785 A | * | 9/1976 | Flory | 141/387 |
| 4,263,004 A | | 4/1981 | Joubert et al. | |
| 4,279,543 A | | 7/1981 | Remery | |
| 4,301,840 A | * | 11/1981 | Jansen | 141/387 |
| 4,423,984 A | | 1/1984 | Panicker et al. | |
| 4,490,121 A | * | 12/1984 | Coppens et al. | 441/5 |
| 4,648,848 A | * | 3/1987 | Busch | 114/230.2 |
| 4,793,737 A | | 12/1988 | Shotbolt | |
| 4,820,217 A | * | 4/1989 | Joubert et al. | 114/293 |
| 4,878,694 A | | 11/1989 | Castel | |
| 5,044,297 A | | 9/1991 | De Baan et al. | |
| 5,065,687 A | * | 11/1991 | Hampton | 441/4 |
| 5,095,841 A | * | 3/1992 | Santos et al. | 441/3 |
| 5,205,768 A | | 4/1993 | Pollack | |
| 5,275,510 A | * | 1/1994 | de Baan et al. | 405/210 |
| 5,288,253 A | | 2/1994 | Urdshals et al. | |
| 5,427,046 A | | 6/1995 | Brown et al. | |
| 5,505,560 A | | 4/1996 | Brown et al. | |
| 5,639,187 A | | 6/1997 | Mungall et al. | |
| 5,651,709 A | * | 7/1997 | Nandakumar et al. | 114/293 |
| 5,816,183 A | * | 10/1998 | Braud et al. | 144/230.13 |
| 5,885,028 A | | 3/1999 | Blanchard et al. | |
| 5,941,746 A | | 8/1999 | Isnard et al. | |
| 5,944,448 A | * | 8/1999 | Williams | 114/230.2 |
| 6,109,833 A | | 8/2000 | Savy | |
| 6,109,989 A | | 8/2000 | Kelm et al. | |
| 6,206,742 B1 | | 3/2001 | Bull et al. | |
| 6,415,828 B1 | * | 7/2002 | Duggal et al. | 141/279 |

FOREIGN PATENT DOCUMENTS

| | | |
|---|---|---|
| GB | 2099894 | 12/1982 |
| GB | 2153332 | 8/1985 |
| GB | 2335723 | 9/1999 |
| JP | 2-214404 | 8/1990 |
| WO | WO 97/06341 | 2/1997 |
| WO | WO 99/66169 | 12/1999 |
| WO | WO 00/21825 | 4/2000 |

* cited by examiner

*Primary Examiner*—S. Joseph Morano
*Assistant Examiner*—Lars A. Olson
(74) *Attorney, Agent, or Firm*—Gary L. Bush; Andrews & Kurth, LLP

(57) ABSTRACT

A system for floating hydrocarbon production systems such as a FPSO that requires a remote mooring terminal for transferring fluids to shuttle tankers. The system includes a single point mooring buoy, such as a CALM floating on the sea surface. Mooring legs anchor the CALM buoy to the sea floor. A submerged Flowline Termination Buoy (FTB) is supported by tension members from the CALM, but with no direct support from the sea floor. A submerged weight is suspended by the FTB and the CALM buoy. The submerged flowlines from the FSPO are supported by the FTB. Flexible hoses fluidly connect the flowlines to the CALM buoy.

21 Claims, 5 Drawing Sheets

FLOWLINE TERMINATION BUOY WITH COUNTERWEIGHT FOR A SINGLE POINT MOORING AND FLUID TRANSFER SYSTEM

BACKGROUND OF THE INVENTION

1. Field of the Invention

This invention relates generally to an offshore loading system such as a CALM which serves as a single point mooring (SPM) for a shuttle tanker or the like and a product transfer system for transferring hydrocarbon product via an associated product flowline arrangement between a production and/or storage facility and the SPM.

2. Description of Prior Art

In deep water operations, certain operational considerations make it desirable to offload hydrocarbons from a production and/or storage facility by running a pipeline to an offshore loading system, such as a CALM buoy, where a shuttle tanker may be moored and connected to a loading hose for filling its tanks with crude oil. Deep water installations, e.g., in depths greater than about 1000 feet, require that the pipeline be suspended between the production and/or storage facilities, such as a platform or FPSO and the CALM buoy rather than running the pipeline along the sea bed. The pipeline must be submerged at a depth deep enough so as not to interfere with shuttle tanker traffic. A problem exists in connecting the end of the pipeline directly to the CALM buoy, because as the buoy moves up and down and side to side, the end of the pipeline moves with it, and as a result is subject to fatigue failure. The term "pipeline" includes steel tubular pipelines as well as bonded and unbonded flexible flowlines fabricated of composite materials.

The problem identified above is inherent in prior offloading deep water CALM buoys which have pipelines attached directly to and supported from a CALM buoy. The pipelines are directly coupled to the CALM buoy such that motions of the CALM buoy are also directly coupled to the pipeline with resulting fatigue damage. Prior systems such as that described in U.S. Pat. No. 5,639,187 have provided a hybrid flowline including rigid (e.g., steel catenary risers) pipelines on the seabed from subsea wells combined with flexible flowlines (e.g., marine hoses) at a submerged buoy which is moored to the seabed by tension leg tether legs. The buoy is positioned at a depth below the turbulence zone of the water. Flexible hoses are fluidly connected to the steel catenary risers at the submerged buoy and extend upward through the turbulence zone to the surface.

Another prior system, described in British Patent GB 2335723 B, attempts to solve the problem identified above by suspending the end of a rigid steel tubular flowline (e.g., the pipeline) by a chain from the offloading buoy and fluidly connecting a flexible hose to the end of the rigid steel flowline below the turbulence zone of the sea. While eliminating a certain level of coupling of wave induced forces to the end of the rigid steel flowline which extends from a production and/or storage facility (FPSO or platform), nevertheless, a sufficient degree of coupling still exists to create a fatigue problem, and possible failure, for the pipeline.

3. Identification of Objects of the Invention

A primary object of the invention is to provide a product transfer system from a FPSO or platform via a pipeline (either rigid or flexible) to an offloading buoy and then to a shuttle tanker while substantially eliminating coupling of wave induced motions of the offloading buoy with the end of the pipeline.

Another object of the invention is to provide a conventional CALM buoy which provides support for a submerged flowline termination buoy for decoupling a submerged pipeline from wave induced motions of the CALM buoy.

Another object of this invention is to provide a submerged flowline termination buoy for support of a submerged pipeline where the buoy is supported by a CALM buoy obviating the need for mooring legs between the flowline termination buoy and the sea floor.

Another object of the invention is to provide a conventional CALM buoy for the product transfer system on which an above-water product swivel is placed so that in-situ servicing of the swivel and CALM buoy can be conducted.

Another object of the invention is to provide an offshore product transfer system that is suitable for use with large diameter, submerged, rigid (e.g., steel) or flexible (e.g., composite) pipelines in deep water.

Another object of the invention is to provide a product transfer system which decouples a submerged pipeline from a surface offloading buoy and its wave induced motions thereby reducing fatigue damage to the pipeline.

Another object of the invention is to provide a product transfer arrangement that allows for optimizing of pipeline diameter and buoyancy, because improved fatigue resistance allows for greater variability in the configuration of the submerged pipeline.

Another object of the invention is to support the flowline in a way that decouples the CALM buoy from the flowline with a resulting low fatigue damage to the flowline at the lowest practical cost.

Another object of the invention is to provide a product transfer arrangement in which the surface offloading buoy can be replaced or repaired easily without disturbing the pipeline from the FPSO or platform with a resulting increase in overall system reliability.

Another object of the invention is to provide a product transfer system that meets the objects described above while employing a conventional surface offloading mooring and hydrocarbon transfer terminal.

SUMMARY OF THE INVENTION

The objects identified above along with other advantages and features are provided in the invention embodied in a product transfer system by which a rigid or flexible pipeline from a FPSO or platform or the like extends in the sea above the seabed for about a nautical mile where it terminates close to a CALM buoy, and where it is fluidly coupled to a flexible hose at a Flowline Termination Buoy (FTB) which is supported solely by the CALM below the wave kinematics zone thereby obviating the need for mooring legs between the FTB and the sea floor. The other end of the flexible hose is coupled to the stationary inlet of a product swivel mounted on a stationary portion of a single point mooring offloading buoy such as a CALM. A shuttle tanker is moored to the CALM buoy by a hawser secured to a rotatable portion of the CALM buoy. A hose from the rotatable output of the product swivel extends to the shuttle tanker to complete the product flow path from the (FPSO or platform) to the shuttle tanker.

BRIEF DESCRIPTION OF THE DRAWINGS

The objects, advantages and features of the invention will become more apparent by reference to the drawings which are appended hereto and wherein an illustrative embodiment of the invention is shown, of which.

DETAILED DESCRIPTION OF THE INVENTION

The double buoy offloading arrangement of this invention is for deep water hydrocarbon offloading from offshore production platforms either fixed (e.g., Jacket structures), or floating (e.g., FPSOs, Semi-submersibles, or Spars). Conventional offloading arrangements provide a single offloading buoy located approximately two kilometers away from the platform, with a submerged flexible or steel pipeline(s) connected between them. With the prior arrangement, the surface offloading buoy requires a large displacement to support the submerged pipeline(s) and their product. Because of its size, the offloading buoy is subject to motions in response to the wave environment. These wave-frequency motions are coupled to the pipeline and affect its dynamic response, leading to fatigue damage to the pipeline over time.

The double buoy concept of this invention effectively eliminates the fatigue damage to one or more pipelines by decoupling the motion of the surface offloading buoy from the pipelines. This is accomplished by using a Flowline Termination Buoy (FTB) submerged beneath the sea surface (on the order of 50–125 meters). The FTB is supported from a CALM buoy, but the FTB supports the pipeline below the wave zone of the sea. No tether legs are required between the sea floor and the FTB. Because the FTB is effectively out of the range of the wave kinematics, it does not exhibit significant response to the wave field, thus reducing the fatigue damage to the pipeline. Offloading to shuttle tankers is performed through the CALM buoy system, which is anchored to the sea floor by an anchor leg array. Standard marine hoses or flexible flowlines connect the CALM buoy to the pipelines supported by the FTB.

Figure 1:
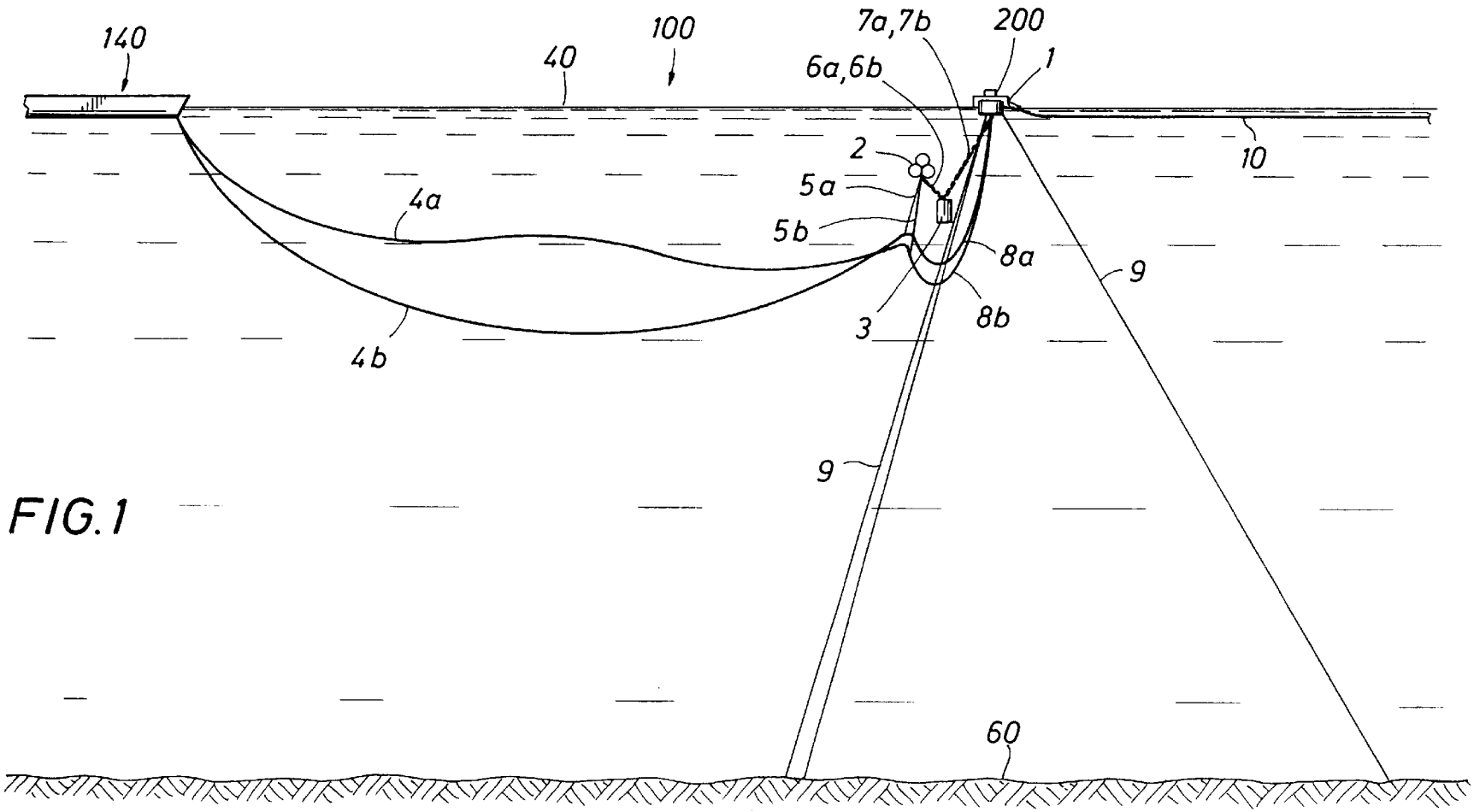
FIG. 1 is a schematic illustration of an arrangement of the invention where an end of a rigid or flexible pipeline from a FPSO or production platform is supported by a Flowline Termination Buoy (FTB) supported from a single point mooring offloading buoy such as a CALM, with a flexible marine hose fluidly connected between the end of the pipeline and a stationary inlet of a product swivel mounted on the CALM.

FIG. 1 shows the general arrangement 100 of the invention where one or more pipelines 4*a*, 4*b* are fluidly connected between a FPSO or platform 140 to a deepwater CALM buoy 1 via a Flowline Termination Buoy 2 (hereafter referred to as "FTB"). The pipelines may have buoyancy modules (not shown) attached along the run of the pipeline and may achieve different depth profiles (as suggested by the illustration of FIG. 1) as a function of distance from the FPSO, if desired. Marine hoses or flexible flowlines 8*a*, 8*b* are fluidly connected to the pipelines at the FTB 2 and a product swivel 200 (see FIG. 2) of CALM buoy 1. Mooring legs 9 couple the CALM buoy 1 at the sea surface 40 to the sea floor 60. The submerged FTB 2 is supported solely from the CALM buoy 1 by tension members 6*a*, 6*b* and 7*a*, 7*b* with counterweight 3.

Figure 3A:
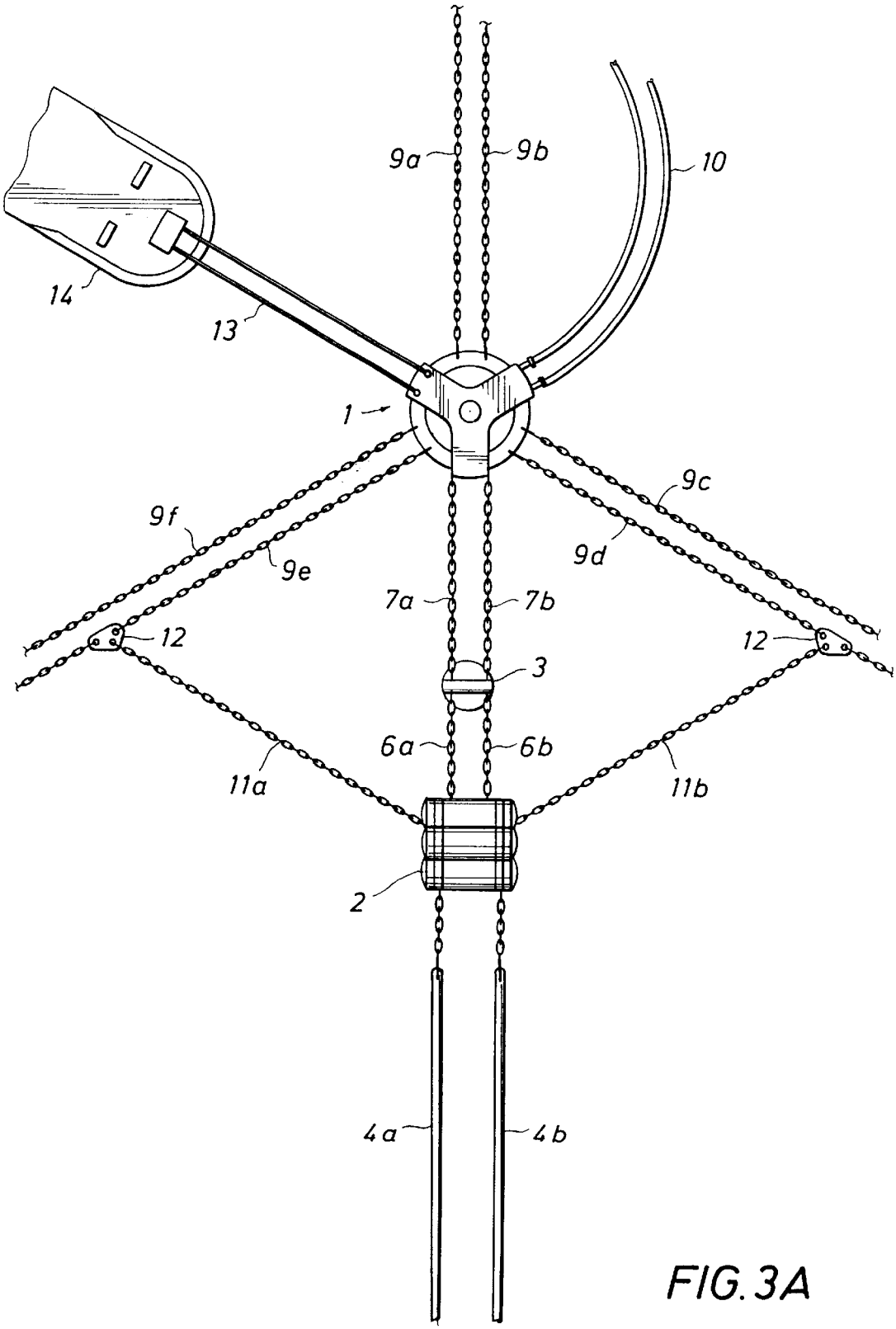
FIGS. 3A (top view), 3B (end view) and 3C (side view) illustrate a preferred embodiment of the Flowline Termination Buoy of the invention.

The pipelines 4*a*, 4*b*, preferably steel tubular members which have flotation attached to them along their path from FPSO 140 to the FTB 2 to prevent excessive sagging due to their heavy weight, do not touch the sea floor. They typically run at least one nautical mile to the vicinity of the CALM offloading buoy 1, but are submerged beneath the sea surface 40 at a depth so that shuttle tankers 14 (as shown in FIG. 3A) can maneuver between the FPSO 140 and the CALM buoy 1 without fear of fouling the pipelines 4*a*, 4*b*. Steel pipelines are rigid in the sense that they are continuous steel tubular members, but of course such steel pipelines have flexibility due to their great weight and the inherent flexibility of a long spaghetti-like steel tubular string. Although the FTB 2 is shown positioned between the FBSO 140 and the CALM buoy 1 as in FIG. 1, it may be positioned to the far side of CALM buoy 1 or at other locations around the CALM buoy.

FIG. 2 and FIGS. 3A, 3B, 3C, 4A, 4B illustrate in detail the names and reference numbers as listed below which are assigned for illustration purposes to the parts of a preferred the invention:

| Reference Number | Item |
|---|---|
| 1 | SPM (e.g., CALM) buoy |
| 2 | Submerged buoy (Flowline Termination Buoy FTB), e.g., of about 430 Ton net buoyancy |
| 3 | Counterweight, e.g., about 300 Ton net weight |
| 4 | Pipelines 4a, 4b |
| 5 | Tension members 5a, 5b |
| 6 | Tension members 6a, 6b |
| 7 | Tension members 7a, 7b |
| 8 | Flexible hoses 8a, 8b |
| 9 | SPM mooring leg 9a, b, . . . f |
| 10 | Floating hose |
| 11 | Lateral catenary chains 11a, 11b |
| 12 | Connector plate (Triplate) |
| 13 | Mooring hawser |
| 14 | Shuttle tanker |
| 20 | Pivoting bracket |
| 21 | Spreader bar |
| 22 | Pivoting bracket |
| 23 | Pin |
| 24 | Bushings |

Figure 2:
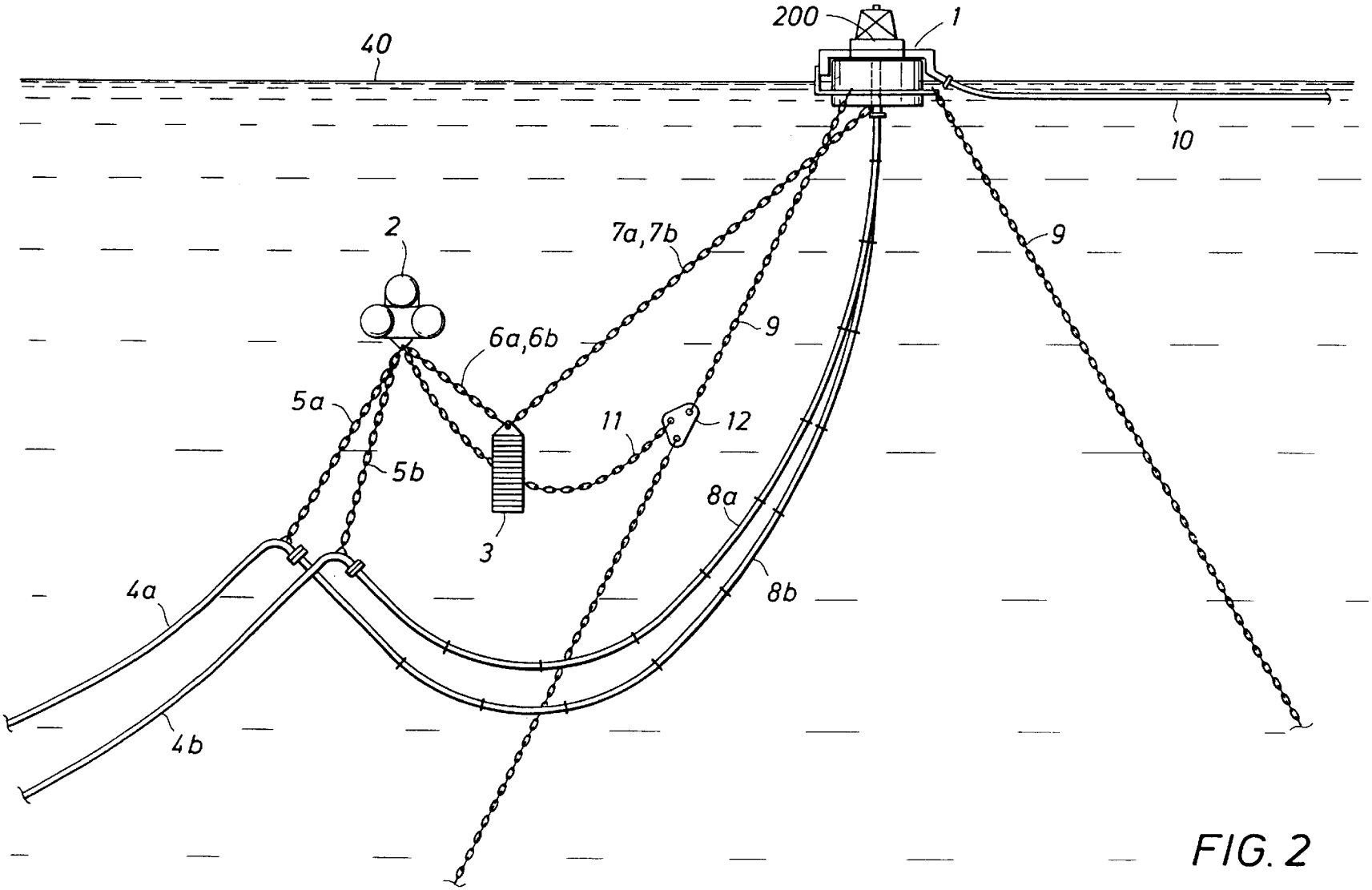
FIG. 2 is a schematic illustration showing more detail of the suspension of one or more rigid or flexible flowline pipelines in a side view of the Flowline Termination Buoy and the fluid connection of the flexible hoses the ends of pipeline.
Figure 3C:
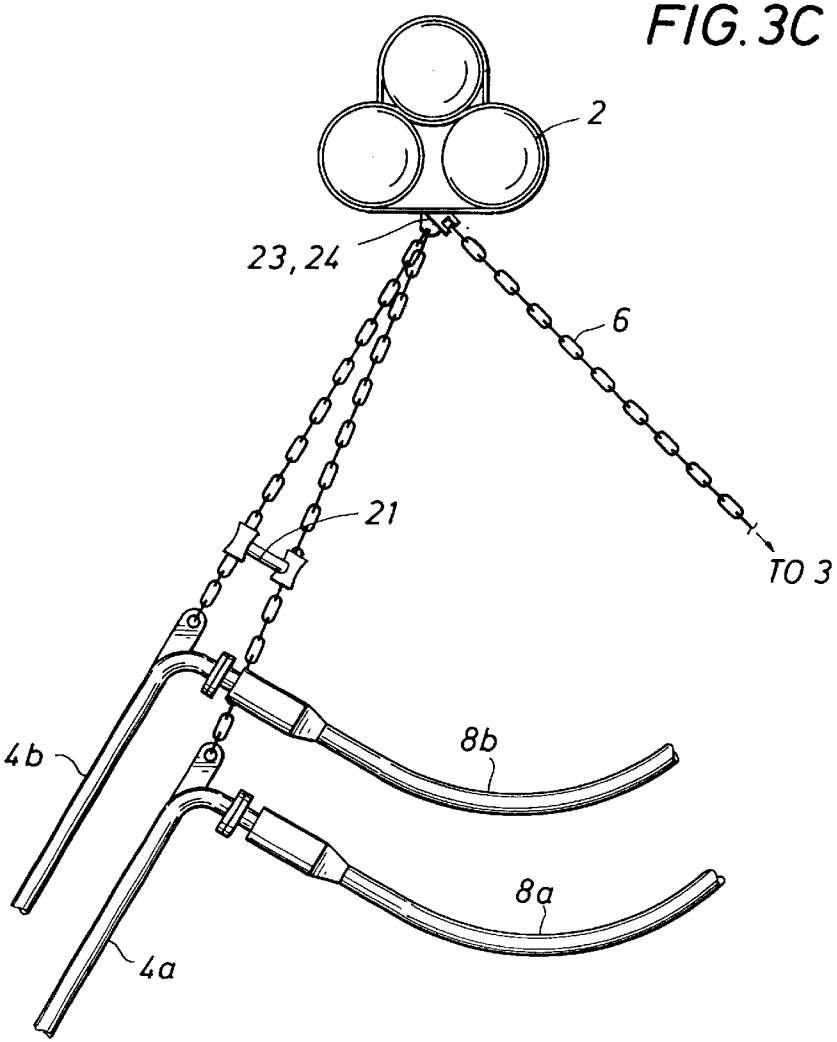

As shown in FIGS. 2, 3A, 3B, 3C, pipelines 4*a*, 4*b* are connected to FTB 2 by tension members 5. Connection may be made by gooseneck members as seen in FIG. 3C as described in copending application Ser. No. 09/659,495, which is incorporated herein by reference for its description of such members. Flexible hoses 8*a*, 8*b* are fluidly coupled to pipelines 4*a*, 4*b* to carry the transported fluid from flowlines 4 to the CALM buoy 1 piping. The transported fluids pass through buoy piping (including a product swivel 200) to floating hoses 10 and then to shuttle tanker 14. Weight 3 is suspended by tension members 6*a*, 6*b* to FTB 2 and by tension members 7*a*, 7*b* to CALM buoy 1.

Weight 3 functions as a spring member between CALM buoy 1 and FTB 2, thereby effectively decoupling the pipeline ends 4*a*, 4*b* from the motion of the CALM buoy 1. After installation and displacement of CALM buoy 1, the weight 3 and pipelines 4*a*, 4*b* always find an equilibrium vertical position due to the relative angles of tension members 6*a*, 6*b* and 7*a*, 7*b* with respect to the position of the submerged FTB 2 and the floating CALM buoy 1.

The length of members 6*a*, 6*b* and 7*a*, 7*b*, the net buoyancy of FTB 2, and the net weight of weight 3 are variables to determine the optimum system performance for a given range of environmental conditions.

When necessary to raise the submerged FTB to the sea surface 40, an anchor handling vessel (AHV) hoists up tension members 7*a*, 7*b*, and the FTB 2 follows to the surface.

FIGS. 2 and 3A, 3B, 3C illustrate an embodiment of the invention to respond to environmental conditions where transverse currents may tend to force the flowlines 4*a*, 4*b* out of line. Lateral chains 11*a*, 11*b* are installed from FTB 2 to connector plates 12 in mooring legs 9*d* and 9*e*. The chains 11*a*, 11*b* prevent excessive lateral displacement of FTB from its position between legs 9*c* and 9*d*. The chains 11*a*, 11*b* are sufficiently long to allow the submerged FTB 2 to float at the sea surface during installation or during later service operations.

Figure 3B:
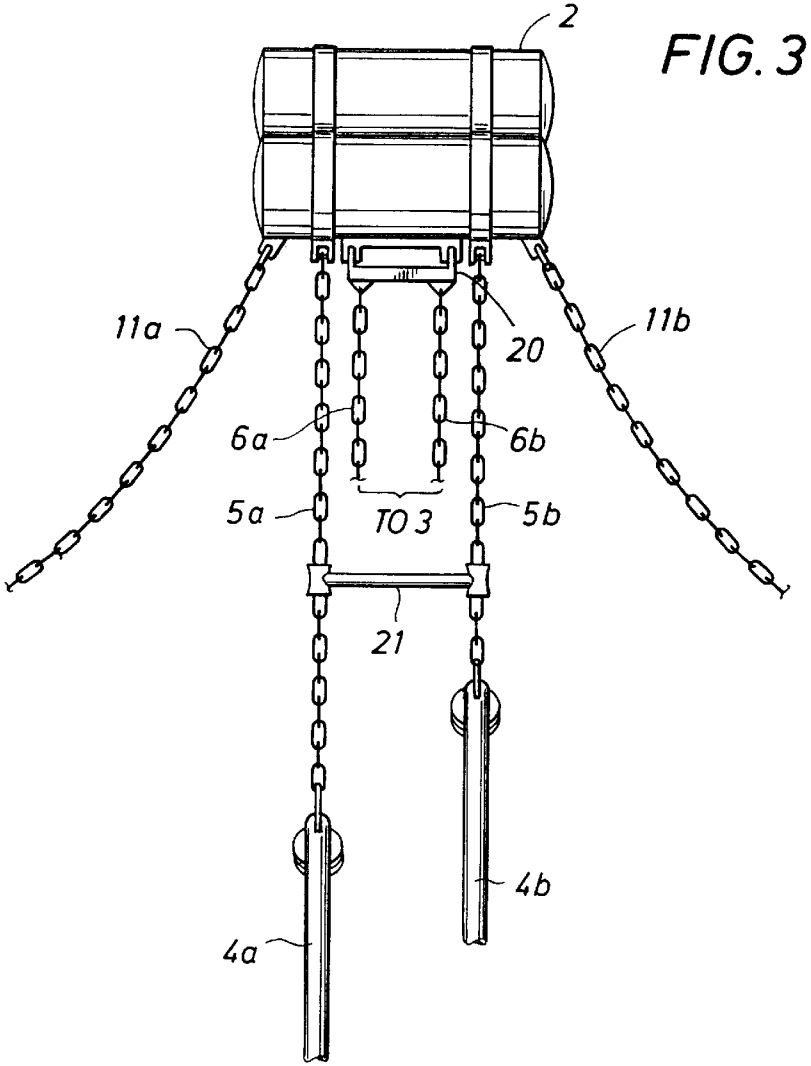
Figure 4B:
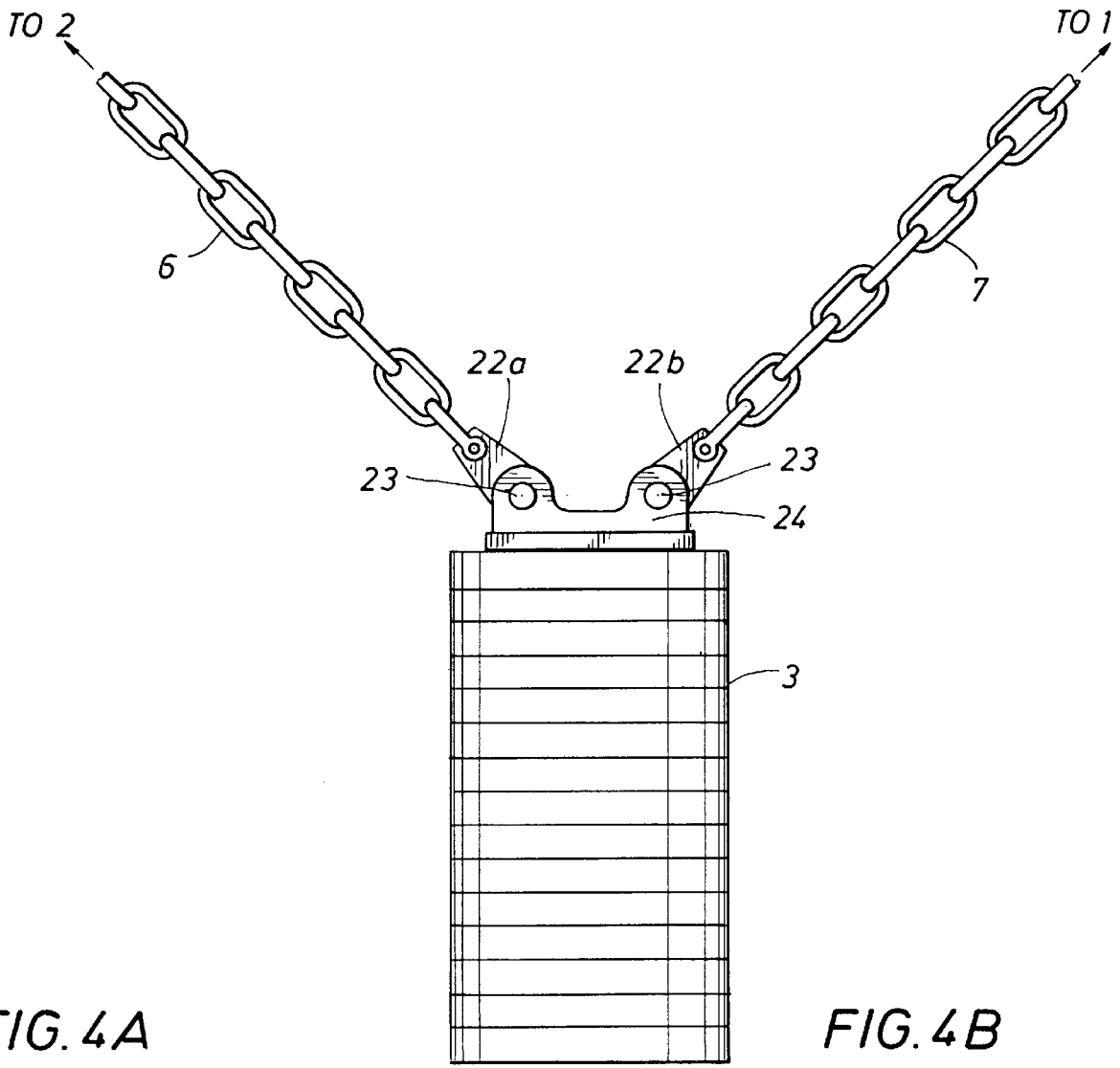
FIGS. 4A (end view) and 4B (front view) illustrate a preferred coupling arrangement between tension members and a suspended weight.
Figure 4A:
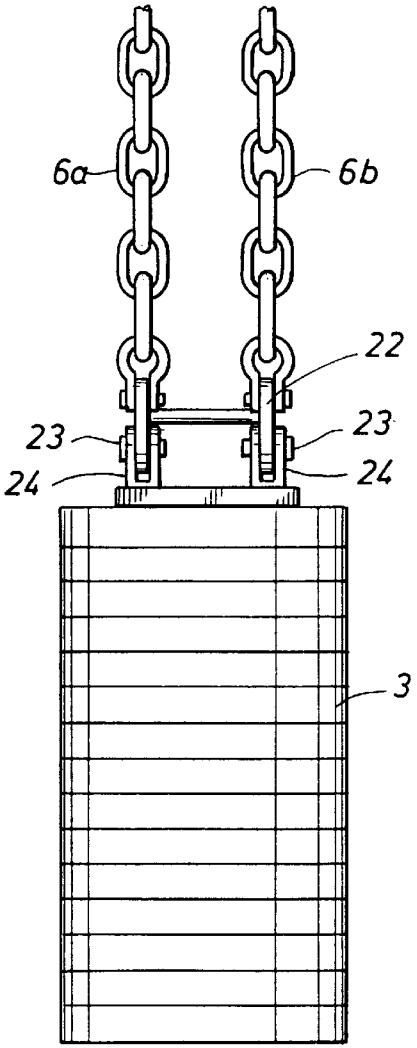

As illustrated in FIGS. 3B and 3C, tension members 5*a*, 5*b* support the ends of pipelines 4*a*, 4*b* from FTB 2. A spreader bar 21 maintains separation of the pipelines. As illustrated in FIGS. 2, 3A and 3B, tension members 6*a*, 6*b* and 7*a*, 7*b* support the FTB from the CALM buoy 1, with the weight 3 provided as described above. Two tension members provide redundancy of the support of FTB 2 to provide safety for the condition if one of the tension members were to fail. The tension members 6*a*, 6*b* are secured to bracket 20 which is pivotally coupled to buoy 2. Self lubricated bushings and pins are used in the pivoting connection because of expected pivoting motion of the tension members 6*a*, 6*b* under operating conditions. Pipelines 4*a*, 4*b* are positioned out of plane horizontally and vertically to prevent clashing.

The end view (FIG. 4A) and the front view (FIG. 4B) of the weight 3 shows that tension members 6 and 7 are coupled to pivoting brackets 22. The brackets 22 are pivotally connected to weight 3 by pins 23 and bushings 24 to account for pivoting motions of the tension members 6 and 7 with respect to weight 3.

What is claimed is:

1. In an offshore arrangement where a pipeline is suspended in the sea between a hydrocarbon facility above a seabed and a single point mooring facility, and an end of said pipeline is in fluid communication with a product swivel on said single point mooring facility, the improvement comprising, a submerged Flowline Termination Buoy positioned in proximity to the single point mooring facility, said Flowline Termination Buoy (FTB) being supported at a position above the seabed by a coupling arrangement between said single point mooring facility and said FTB, a suspending member carried by said FTB and mechanically coupled to said end of the pipeline, and a marine hose having an input end fluidly coupled to said end of said pipeline and an outlet end fluidly coupled to said product swivel on said single point mooring facility.

2. The improvement of claim 1 wherein, said hydrocarbon facility is a floating storage production and offloading vessel.

3. The improvement of claim 1 wherein, said FTB is without mooring legs to the sea floor.

4. The improvement of claim 1 wherein, said single point mooring facility is a Catenary Anchor Leg Mooring (CALM) buoy which is arranged and designed for offshore mooring of a shuttle tanker.

5. The improvement of claim 1 wherein, said pipeline is formed by a plurality of steel tubular members joined end to end.

6. The improvement of claim 1 wherein, said pipeline is a tubular member fabricated with composite materials.

7. The improvement of claim 1 wherein, said suspending member is a flexible tension member.

8. The improvement of claim 1 wherein, said coupling arrangement includes spring means for decoupling said end of said pipeline from wave induced motions of said single point mooring facility.

9. The improvement of claim 1 wherein, said coupling arrangement includes a weight, a first tension member coupled between said submerged FTB and said weight, and a second tension member coupled between said weight and said single point mooring facility.

10. The improvement of claim 1 wherein, said single point mooring facility is a Catenary Anchor Leg Mooring (CALM) buoy with plural anchor legs extending in an array from the CALM buoy to the sea floor, said FTB is positioned between first and second anchor legs of said plural anchor legs, a first lateral catenary chain is secured between said first one of said anchor legs and said FTB, and a second lateral catenary chain is secured between said second one of said anchor legs and said FTB, with said first and second lateral chains preventing excessive lateral displacement of said FTB from its position between said first and second anchor legs.

11. The improvement of claim 1 wherein, two pipelines extend from said hydrocarbon facility through the sea to said single point mooring facility, and said suspending member includes a first chain extending from said FTB to an end of a first one of said two pipelines, and a second chain extending from said FTB to an end of a second one of said two pipelines, and a spreader bar is secured laterally between said first and second chains for separation of said ends of said pipeline.

12. The improvement of claim 9 wherein, said first tension member includes first and second parallel chains coupled between said FTB and said weight, and said second tension member includes third and fourth parallel chains coupled between said weight and said single point mooring facility.

13. The improvement of claim 12 further comprising means for pivotally coupling first ends of said first and second chains to said weight, and means for pivotally coupling ends of said third and fourth chains to said weight.

14. The improvement of claim 13 further comprising means for pivotally coupling second ends of said first and second chain to said FTB.

15. In an offshore arrangement where a pipeline is suspended in the sea between a hydrocarbon facility above a seabed and a single point mooring facility, and an end of said pipeline is in fluid communication with a product swivel on said single point mooring facility, the improvement comprising, a submerged Flowline Termination Buoy positioned in proximity to the single point mooring facility, said Flowline Termination Buoy (FTB) being supported at a position above the seabed by a coupling arrangement between said single point mooring facility and said FTB, a suspending member carried by said FTB and mechanically coupled to said end of the pipeline, and a marine hose having an input end fluidly coupled to said end of said pipeline and an outlet end fluidly coupled to said product swivel on said single point mooring facility, wherein said coupling arrangement includes spring means for decoupling said end of said pipeline from wave induced motions of said single point mooring facility.

16. In an offshore arrangement where a pipeline is suspended in the sea between a hydrocarbon facility above a seabed and a single point mooring facility, and an end of said pipeline is in fluid communication with a product swivel on said single point mooring facility, the improvement comprising, a submerged Flowline Termination Buoy positioned in proximity to the single point mooring facility, said Flowline Termination Buoy (FTB) being supported at a position above the seabed by a coupling arrangement between said single point mooring facility and said FTB, a suspending member carried by said FTB and mechanically coupled to said end of the pipeline, and a marine hose having an input end fluidly coupled to said end of said pipeline and an outlet end fluidly coupled to said product swivel on said single point mooring facility, wherein said coupling arrangement includes a weight, a first tension member coupled between said submerged FTB and said weight, and a second tension member coupled between said weight and said single point mooring facility.

17. In an offshore arrangement where a pipeline is suspended in the sea between a hydrocarbon facility above a seabed and a single point mooring facility, and an end of said pipeline is in fluid communication with a product swivel on said single point mooring facility, the improvement comprising, a submerged Flowline Termination Buoy positioned in proximity to the single point mooring facility, said Flowline Termination Buoy (FTB) being supported at a position above the seabed by a coupling arrangement between said single point mooring facility and said FTB, a suspending member carried by said FTB and mechanically coupled to said end of the pipeline, and a marine hose having an input end fluidly coupled to said end of said pipeline and an outlet end fluidly coupled to said product swivel on said single point mooring facility, wherein said single point mooring facility is a Catenary Anchor Leg Mooring (CALM) buoy with plural anchor legs extending in an array from the CALM buoy to the sea floor, said FTB is positioned between first and second anchor legs of said plural anchor legs, a first lateral catenary chain is secured between said first one of said anchor legs and said FTB, and a second lateral catenary chain is secured between said second one of said anchor legs and said FTB, with said first and second lateral chains preventing excessive lateral displacement of said FTB from its position between said first and second anchor legs.

18. In an offshore arrangement where a pipeline is suspended in the sea between a hydrocarbon facility above a seabed and a single point mooring facility, and an end of said pipeline is in fluid communication with a product swivel on said single point mooring facility, the improvement comprising, a submerged flowline termination buoy positioned in proximity to the single point mooring facility, said Flowline Termination Buoy (FTB) being supported at a position above the seabed by a coupling arrangement between said single point mooring facility and said FTB, a suspending member carried by said FTB and mechanically coupled to said end of the pipeline, and a marine hose having an input end fluidly coupled to said end of said pipeline and an outlet end fluidly coupled to said product swivel on said single point mooring facility, wherein, two pipelines extend from said hydrocarbon facility through the sea to said single point mooring facility, and said suspending member includes a first chain extending from said FTB to an end of a first one of said two pipelines, and a second chain extending from said FTB to an end of a second one of said two pipelines, and a spreader bar is secured laterally between said first and second chains for separation of said ends of said pipeline.

19. In an offshore arrangement where a pipeline is suspended in the sea between a hydrocarbon facility above a seabed and a single point mooring Facility, and an end of said pipeline is in fluid communication with a product swivel on said single point mooring facility, the improvement comprising, a submerged Flowline Termination Buoy positioned in proximity to the single point mooring facility, said Flowline Termination Buoy (FTB) being supported at a position above the seabed by a coupling arrangement between said single point mooring facility and said FTB, a suspending member carried by said FTB and mechanically coupled to said end of the pipeline, and a marine hose having an input end fluidly coupled to said end of said pipeline and an outlet end fluidly coupled to said product swivel on said single point mooring facility, wherein, said coupling arrangement includes a weight, a first tension member coupled between said submerged FTB and said weight, and a second tension member coupled between said weight and said single point mooring facility, and wherein said first tension member includes first and second parallel chains coupled between said FTB and said weight, and said second tension member includes third and fourth parallel chains coupled between said weight and said single point mooring facility.

20. In an offshore arrangement where a pipeline is suspended in the sea between a hydrocarbon facility above a seabed and a single point mooring facility, and an end of said pipeline is in fluid communication with a product swivel on said single point mooring facility, the improvement comprising, a submerged Flowline Termination Buoy positioned in proximity to the single point mooring facility, said Flowline Termination Buoy (FTB) being supported at a position above the seabed by a coupling arrangement between said single point mooring facility and said FTB, a suspending member carried by said FTB and mechanically coupled to said end of the pipeline, and a marine hose having an input end fluidly coupled to said end of said pipeline and an outlet end fluidly coupled to said product swivel on said single point mooring facility, wherein said coupling arrangement includes a weight, a first tension member is coupled between said submerged FTB and said weight, and a second tension member is coupled between said weight and said single point mooring facility, wherein said first tension member includes first and second parallel chains coupled between said FTB and said weight, and said second tension member includes third and fourth parallel chains coupled between said weight and said single point mooring facility, and further including means for pivotally coupling first ends of said first and second chains to said weight, and means for pivotally coupling ends of said third and fourth chains to said weight.

21. In an offshore arrangement where a pipeline is suspended in the sea between a hydrocarbon facility above a seabed and a single point mooring facility, and an end of said pipeline is in fluid communication with a product swivel on said single point mooring facility, the improvement comprising, a submerged Flowline Termination Buoy positioned in proximity to the single point mooring facility, said Flowline Termination Buoy (FTB) being supported at a position above the seabed by a coupling arrangement between said single point mooring facility and said FTB, a suspending member carried by said FTB and mechanically coupled to said end of the pipeline, and a marine hose having an input end fluidly coupled to said end of said pipeline and an outlet end fluidly coupled to said product swivel on said single point mooring facility, wherein said coupling arrangement includes a weight, a first tension member coupled between said submerged FTB and said weight, and a second tension member coupled between said weight and said single point mooring facility, wherein said first tension member includes first and second parallel chains coupled between said FTB and said weight, and said second tension member includes third and fourth parallel chains coupled between said weight and said single point mooring facility, and further including, means for pivotally coupling first ends of said first and second chains to said weight, and means for pivotally coupling ends of said third and fourth chains to said weight, and means for pivotally coupling second ends of said first and second chain to said FTB.

* * * * *